US005895552A

United States Patent [19]

Matsuguchi

[11] Patent Number: 5,895,552

[45] Date of Patent: *Apr. 20, 1999

[54] BONDING APPARATUS FOR CUTTING LABEL CONTINUUM HAVING LABELS FORMED SUCCESSIVELY AND BONDING LABEL TO OBJECT

[75] Inventor: Yutaka Matsuguchi, Osaka, Japan

[73] Assignee: Osaka Sealing Printing Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/526,838

[22] Filed: Sep. 11, 1995

[30] Foreign Application Priority Data

Sep. 14, 1994 [JP] Japan ..... 6-247190

[51] Int. Cl.[6] ..... B26D 5/00

[52] U.S. Cl. ..... 156/354; 156/362; 156/395; 156/499; 156/510; 156/516; 156/521; 156/517; 425/126.1

[58] Field of Search ..... 156/354, 362, 156/395, 391, 499, 510, 517, 521, 516, DIG. 21, DIG. 25, DIG. 28, DIG. 33, DIG. 37, DIG. 51; 425/126.1

[56] References Cited

U.S. PATENT DOCUMENTS

| | | | |
|---|---|---|---|
| 4,707,211 | 11/1987 | Shibata . | |
| 5,032,344 | 7/1991 | Kaminski | 264/504 |
| 5,082,439 | 1/1992 | Kaminski | 425/504 |
| 5,205,106 | 4/1993 | Zimmermann et al. | 53/108 |
| 5,284,667 | 2/1994 | Zimmermann et al. | 426/420 |
| 5,540,369 | 7/1996 | Boreali et al. . | |

FOREIGN PATENT DOCUMENTS

| | | |
|---|---|---|
| 071191 | 2/1983 | European Pat. Off. . |
| 370642 | 5/1990 | European Pat. Off. . |
| 577241 | 1/1994 | European Pat. Off. . |
| 637547 | 2/1995 | European Pat. Off. . |
| 2217032 | 10/1973 | Germany . |
| 2007159 | 5/1979 | United Kingdom . |

*Primary Examiner*—Merrick Dixon
*Attorney, Agent, or Firm*—Jordan and Hamburg

[57] ABSTRACT

The bonding apparatus includes a belt for feeding a label continuum (10) in which labels have been continuously formed. The label continuum fed by the belt is cut to a predetermined length to obtain a label strip by a cutter. A pressure-sensitive adhesive layer is formed on a rear surface of the label strip. The label strip obtained by the cutting operation of the cutter is fed by a belt having a label-contact surface not easily bonded to the pressure-sensitive adhesive layer. The label strip is fed to a bonding position with the pressure-sensitive adhesive layer thereof lightly bonded to the label-contact surface of the belt. The label strip fed by the belt is pressed against an object by a bonding roller serving and bonded thereto.

23 Claims, 5 Drawing Sheets

BONDING APPARATUS FOR CUTTING LABEL CONTINUUM HAVING LABELS FORMED SUCCESSIVELY AND BONDING LABEL TO OBJECT

BACKGROUND OF THE INVENTION

1. Field of the Invention

The present invention relates to a bonding apparatus for bonding a label to an object, and more particularly, to the bonding apparatus for cutting a separator-unprovided label continuum, i.e. the so-called non-separable type of label continuum, in which labels have been successively formed to a predetermined length and bonding each label strip thus obtained to the object.

2. Description of the Prior Art

Most of such conventional label continuum have separators. Labels having the same configuration are temporarily attached to a separation agent layer of the separator at predetermined intervals. Label-bonding apparatuses for separating each label from the separator and bonding it to the object have been developed and manufactured.

The conventional separator-provided label continuum comprising labels formed successively has, however, a problem that a great number of separators are wasted. In order to prevent resources from being wasted, a separator-unprovided label continuum comprising labels formed successively have been developed.

SUMMARY OF THE INVENTION

It is accordingly a main object of the present invention to provide an improved bonding apparatus for cutting a separator-unprovided label continuum in which labels have been continuously formed to a predetermined length and bonding each label strip thus obtained to an object.

A bonding apparatus for bonding a label to an object according to the present invention comprises a first feeding means for feeding a label continuum in which labels have been continuously formed at predetermined intervals; a cutting means for cutting the label continuum fed by the first feeding means to a predetermined length to form a label strip; and a second feeding means on which a label-contact surface having a configuration not easily bonded to a pressure-sensitive adhesive layer of the label strip formed by the cutting operation of the cutting means is formed to feed the label strip to a bonding position at which the label strip is bonded to the object by holding the label strip on the label-contact surface.

In this bonding apparatus, the label continuum is fed by the first feeding means, and then, cut to a predetermined length by the cutting means to obtain a label strip. Then, the label strip thus obtained is fed to the bonding position at which the label strip is bonded to the object. Therefore, according to the present invention, the non-separable type of label continuum is cut to a predetermined length, and each label strip thus obtained is bonded to the object.

According to the present invention, the first feeding means may include a belt having a predetermined width, and the belt may have a label-contact surface on which separation treatment has been performed to feed the label continuum by holding the adhesive layer thereof on the label-contact surface thereof. According to the construction, the label continuum can be fed without being curled. Thus, the cutting means is capable of easily cutting the label continuum to a predetermined configuration so as to obtain a label strip.

According to the present invention, the first feeding means may include a belt having a predetermined width, and the belt may have a label-contact surface having a plurality of projections and recesses formed thereon to feed the label continuum by holding the adhesive layer thereof on the projections of the label-contact surface of the belt. According to the construction, the label continuum can be fed without being curled. Thus, the cutting means is capable of easily cutting the label continuum to a predetermined configuration so as to obtain a label strip.

According to the present invention, the second feeding means may include a belt having a predetermined width, and the belt may have a label-contact surface on which separation treatment has been performed to feed the label continuum by holding the adhesive layer of the label strip on the label-contact surface thereof. According to the construction, the label strip can be fed to the bonding position without being curled and can be bonded to the object accurately and beautifully.

According to the present invention, the second feeding means may include a thermal head provided at a position confronting a surface, of the label strip, positioned on a side reverse to the pressure-sensitive adhesive layer thereof. Accordingly, a heat-sensitive colorable layer of the label strip formed on the side reverse to the pressure-sensitive adhesive layer is colored by means of the thermal head to display appropriate information.

The above and further objects, features, aspects, and advantages of the present invention will be more fully apparent from the following detailed description with the accompanying drawings.

DESCRIPTION OF THE PREFERRED EMBODIMENTS

Figure 1:
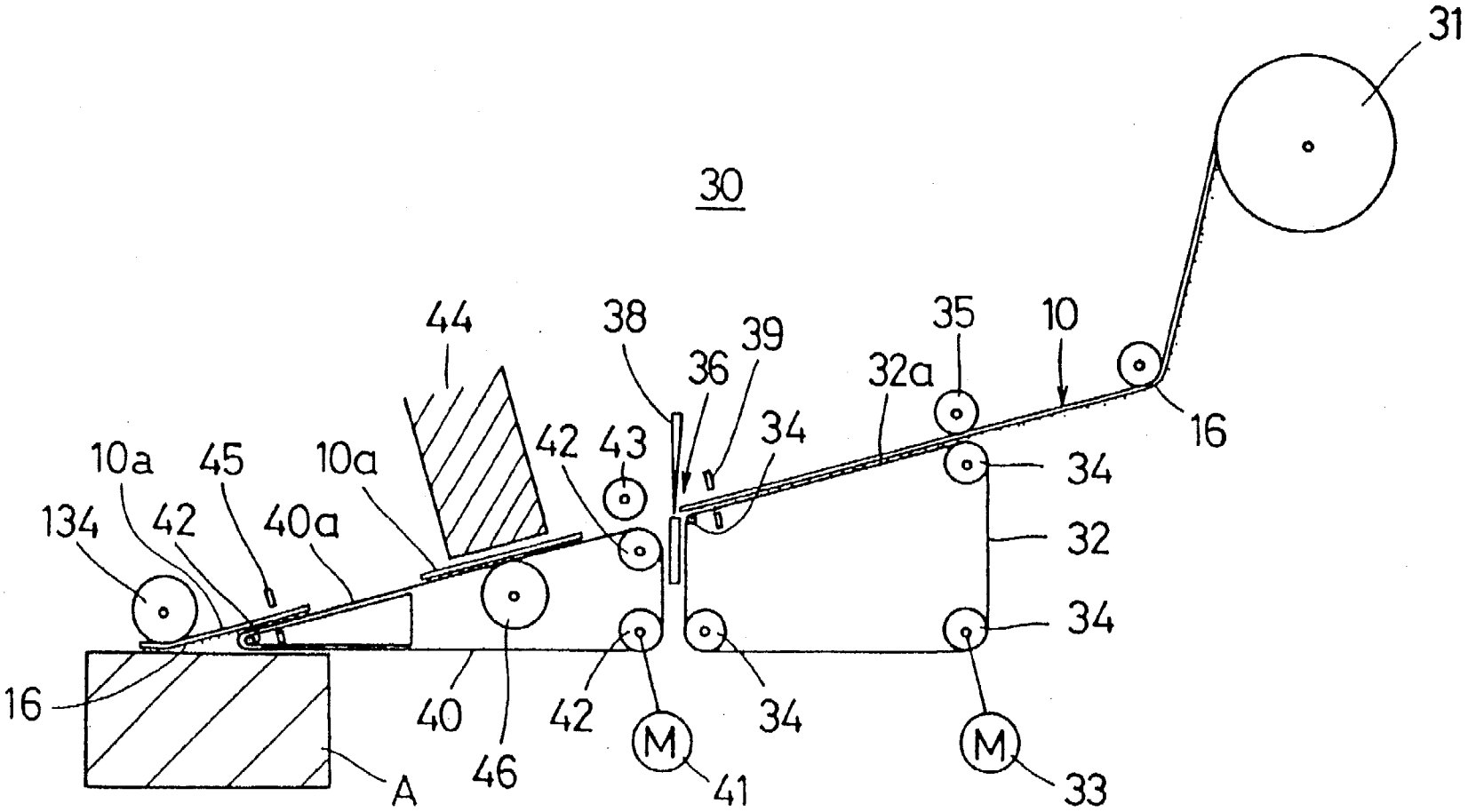
FIG. 1 is an illustration showing a cutting/bonding apparatus, according to an embodiment of the present invention, for cutting a label continuum in which a plurality of labels have been formed to predetermined lengths and continuously bonding each label strip thus obtained to an object.
Figure 2:
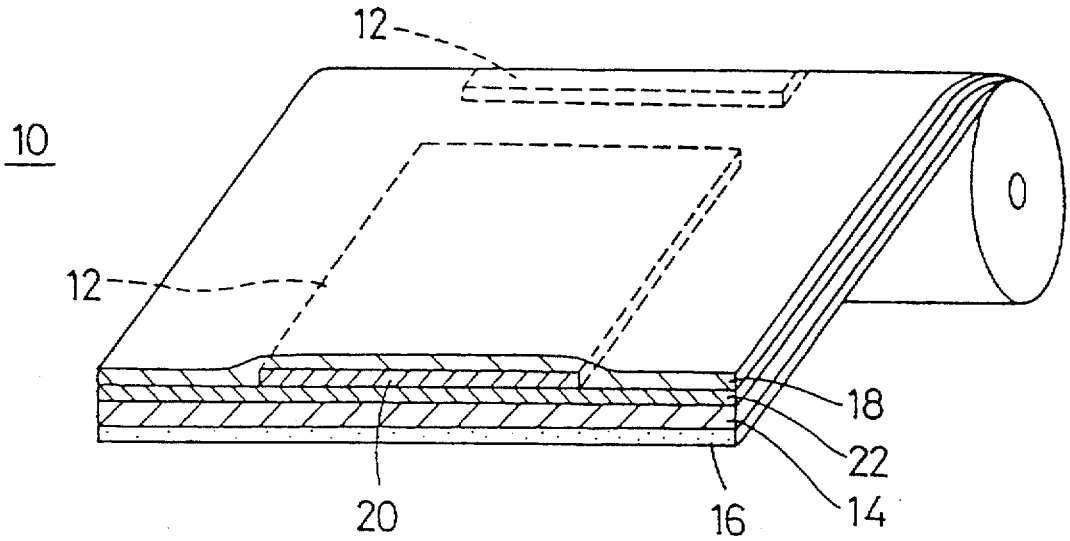
FIG. 2 is an illustration showing the label continuum shown in FIG. 1.

FIG. 1 is an illustration showing a cutting/bonding apparatus, according to an embodiment of the present invention, for cutting a label continuum in which a plurality of labels have been formed to predetermined lengths and continuously bonding each label strip thus obtained to an object. FIG. 2 is an illustration showing the label continuum shown in FIG. 1. The label continuum in which the nonseparator labels have been continuously formed is hereinafter referred to as merely the label continuum.

A long and narrow label continuum 10 to be used in the embodiment shown in FIG. 1 comprises a plurality of labels 12 arranged at regular intervals. The label continuum 10 is cut at the boundary between adjacent labels 12 to form a plurality of label strips 10*a*.

The label continuum 10 comprises a pressure-sensitive adhesive layer 16 positioned lowermost; a base layer 14, a heat-sensitive colorable layer 22; a printed layer 20; and a separation agent layer 18 positioned uppermost. The printed layer 20 to be formed as the label 12 is at regular intervals provided on a part of the heat-sensitive colorable layer 22.

As shown in FIG. 2, before the label continuum 10 is cut, the base layer 14 is rolled so that the pressure-sensitive adhesive layer 16 is temporarily attached to the separation agent layer 18. Further, a heat-sensitive colorable layer 22 is formed so as to be sandwiched between the separation agent layer 18 and the base layer 14.

The label continuum 10 is rolled around a rewinding roll 31 of a cutting/bonding apparatus 30 shown in FIG. 1. The label continuum 10 mounted on the rewinding roll 31 is fed to a belt 32 constituting a first feeding means while the label continuum 10 is being rewound from the rewinding roll 31. The belt 32 is endless and mounted on four rollers 34 spaced from each other at certain intervals. The belt 32 is fed in a label-feeding direction by the rotational force of a motor 33 connected with one of the rollers 34.

In the belt 32, silicone resin or the like is applied to form a separation layer on the upper surface of a contact surface 32*a* which contacts the pressure-sensitive adhesive layer 16 of the label continuum 10. The separation layer thus formed prevents the contact surface 32*a* of the belt 32 from being completely bonded to the pressure-sensitive adhesive layer 16. The width of the belt 32 is set to be greater than that of the label continuum 10 so that the label continuum 10 is not curled in its width direction and is correctly cut downstream. It is possible to provide an applying device (not shown) for applying separation agent to the contact surface 32*a* at a position proximate to the belt 32 so as to allow the contact surface 32*a* of the belt 32 to have separation property.

A pressing roller 35 comparatively elastic or flexible is provided in opposition to the contact surface 32*a* so as to bring the label continuum 10 into contact with the contact surface 32*a* of the belt 32 at a small force. The pressing roller 35 is pressed against the upper surface of the label continuum 10 at a small force.

A cutter 38 serving as a cutting means for cutting the label continuum 10 fed by the belt 32 serving as the first feeding means is provided at a position proximate to a direction-converting portion 36 of the belt 32. The label continuum 10 fed by the operation of the belt 32 and the roller 34 as the first feeding means is successively cut at the boundary between the adjacent labels 12 by the cutter 38 so as to form the label strips 10*a* each having a predetermined length. The cutter 38 is operated in correspondence to electric signals outputted from a sensor 39 such as a photo-switch provided in proximity to the direction-converting portion 36 of the belt 32 or to the cutter 38.

A belt 40 serving as a second feeding means is provided at a position proximate to the cutter 38. The belt 40 is spanned on rollers 42 and driven by a motor 41 so that the label strips 10*a* are fed downward from a position proximate to the cutter 38 to a bonding position, with the label strips 10*a* being spaced at predetermined intervals, at which the label strip 10*a* is bonded to an object (A). To this end, the rollers 42 are so arranged that the belt 40 is inclined downward toward the bonding position.

The belt 40 is spanned on rollers 42 and driven in such a manner that the belt 40 forms an acute angle in proximity to the bonding position.

As in the case of the first feeding means, a separation layer made of silicone resin or the like is formed on the upper surface of the contact surface 40*a* so as to feed the label strip 10*a* forward, with the contact surface 40*a* lightly bonded to the pressure-sensitive adhesive layer 16 of the label strip 10*a*. A pressing roller 43 comparatively elastic or flexible is provided in opposition to the belt 40 so that the pressing roller 43 is pressed against the upper surface of the label strip 10*a* at a small force. In this manner, the pressure-sensitive adhesive layer 16 of the label strip 10*a* is bonded lightly to the contact surface 40*a* of the belt 40.

A thermal head 44 for heating the heat-sensitive colorable layer 22 of the label strip 10*a* fed by the belt 40 is provided subsequently to the pressing roller 43. A platen 46 is provided in opposition to the thermal head 44 in such a manner that the belt 40 is interposed between the thermal head 44 and the platen 46.

Thus, in the label strip 10*a* fed by the belt 40, the heat-sensitive colorable layer 22 is colored by means of the thermal head 44 to form a display portion. Then, a bonding roller 134 serving as a bonding means is pressed against the label strip 10*a* to bond the label strip 10*a* to the object (A) at a predetermined timing by controlling the feeding of the belt 40 in correspondence to electric signals outputted from a sensor 45 such as a photo-switch.

It is unnecessary to form the separation layer on the belt 32 serving as the first feeding means if adhesive agent of delayed tack type is selected as the pressure-sensitive adhesive layer 16 of the label continuum 10. In this case, however, it is necessary to provide an activating device for heating the adhesive agent of delayed tack type so that the pressure-sensitive adhesive layer 16 is adhesive, while the label strip 10*a* is being fed by the belt 40 serving as the second feeding means.

The present invention is not limited to the above-described embodiment, but may be modified in various modes.

Figure 3:
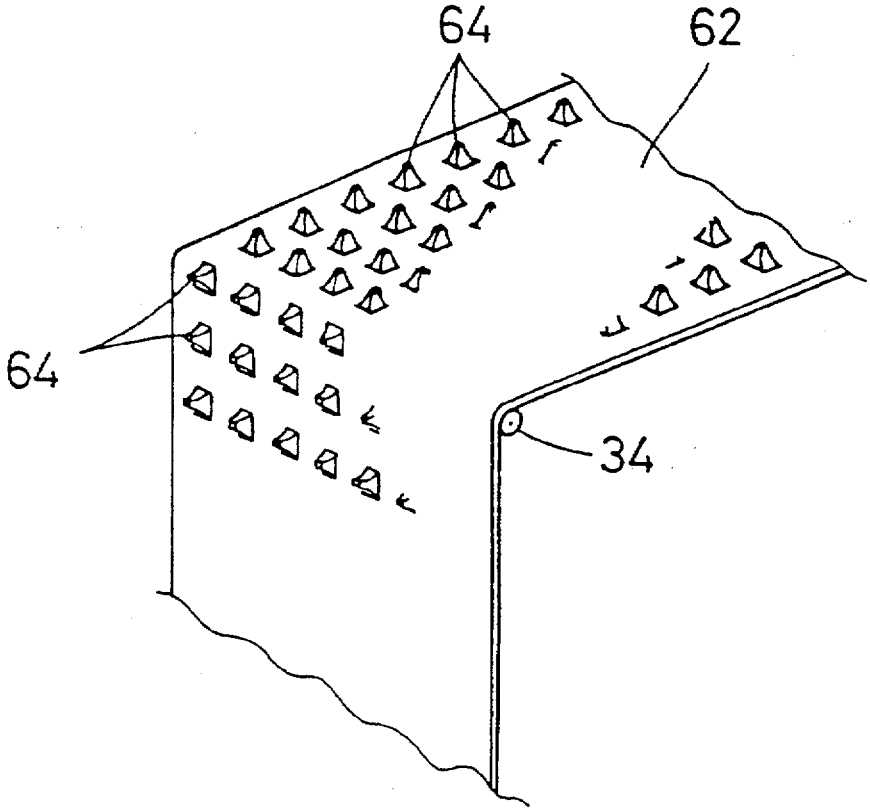
FIG. 3 is an illustration showing main portions of a cutting/bonding apparatus according to a modification of the present invention.
Figure 4:
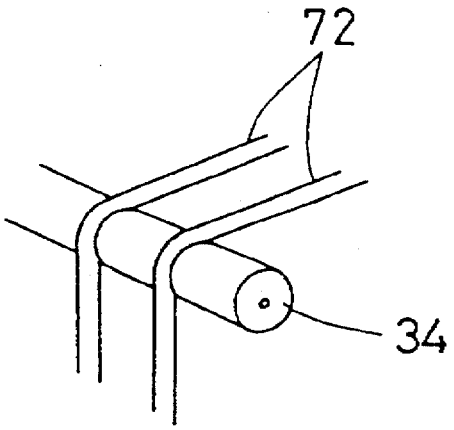
FIG. 4 is an illustration showing main portions of a cutting/bonding apparatus according to another modification of the present invention.

For example, the label continuum 10 may be transported by a belt 62 serving as a first feeding means, with the pressure-sensitive adhesive layer 16 of the label continuum 10 being in light contact with projections 64 of a belt 62, as shown in FIG. 3. As another example, the label continuum 10 may be fed by a plurality of belts 72, sectionally circular and made of rubber, mounted on the rollers 34, as shown in FIG. 4. In these modifications, the label continuum 10 is fed, with the belt 62 or 72 in an incomplete adherence to the label continuum 10.

Figure 5:
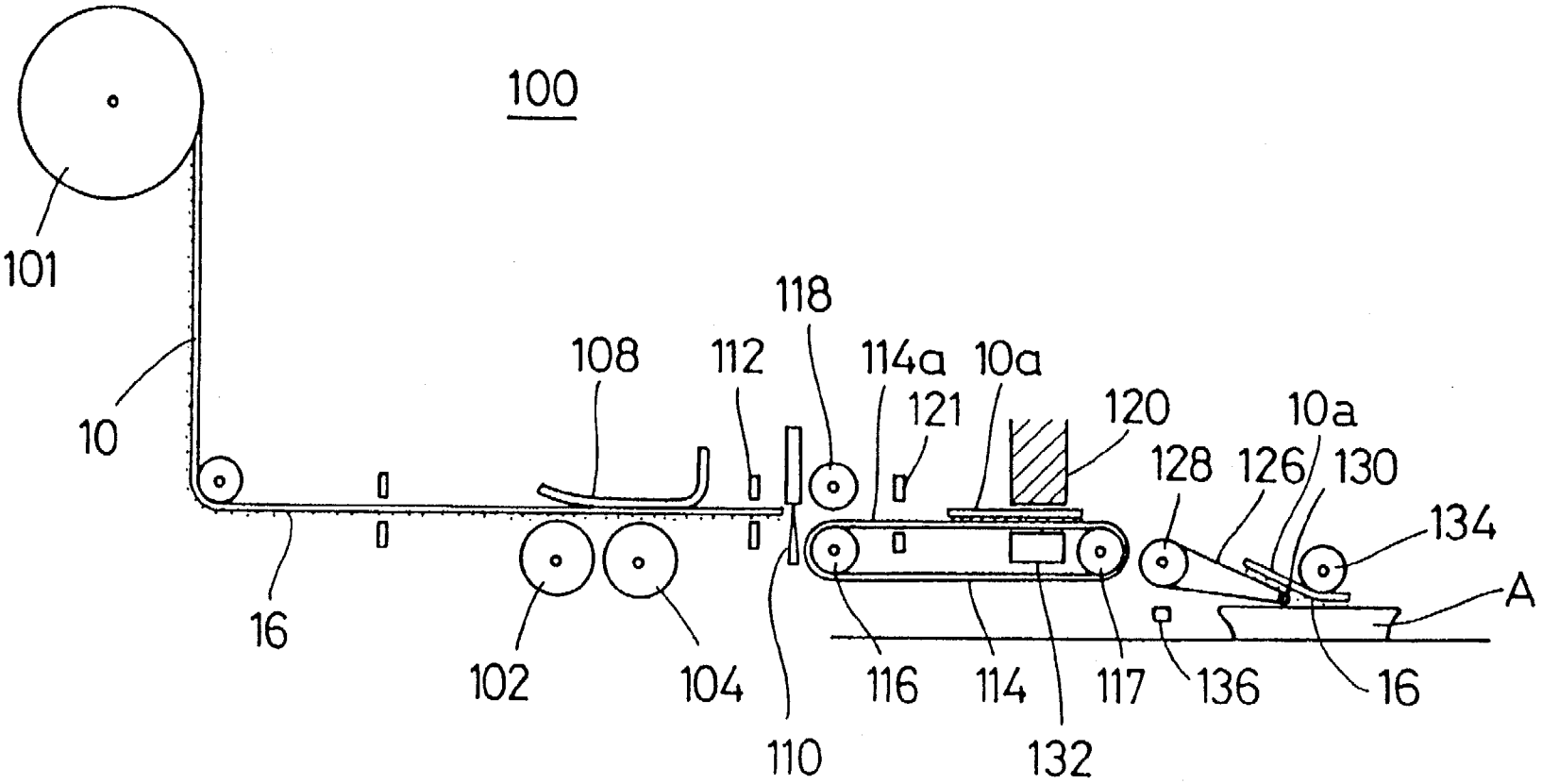
FIG. 5 is an illustration showing a cutting/bonding apparatus according to another embodiment of the present invention.
Figure 6:
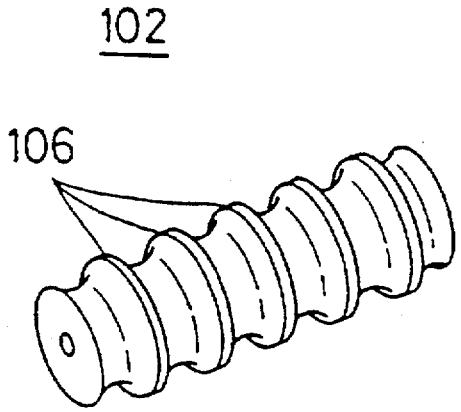
FIG. 6 is an illustration showing a main portion of the cutting/bonding apparatus shown in FIG. 5.

Further, the present invention may be modified to embodiments shown in FIGS. 5 and 6.

FIG. 5 is an illustration showing a cutting/bonding apparatus according to another embodiment of the present invention. FIG. 6 is an illustration showing a main portion of the cutting/bonding apparatus shown in FIG. 5.

The label continuum 10 is rolled around a rewinding roll 101 of a cutting/bonding apparatus 100. The label continuum 10 is fed to a pair of rollers 102 and 104 constituting a first feeding means and spaced from each other at a certain interval, while the label continuum 10 is being rewound from the rewinding roll 101. The rollers 102 and 104 have a plurality of projections 106 to be brought into contact with the pressure-sensitive adhesive layer 16 of the label continuum 10 formed on the surface thereof. The rollers 102 and 104 are rotated in a label-feeding direction.

Only the projections 106 of the rollers 102 and 104 are brought into contact with the pressure-sensitive adhesive layer 16 of the label continuum 10. The projections 106 prevents the rollers 102 and 104 from being completely bonded to the pressure-sensitive adhesive layer 16 of the label continuum 10. The width of the rollers 102 and that of the roller 104 are set to be greater than that of the label continuum 10 so that the label continuum 10 is not curled in its width direction and is correctly cut downstream.

A pressing plate 108 comparatively elastic or flexible is provided in opposition to the rollers 102 and 104 so as to bring the label continuum 10 into contact with the projections 106 of the rollers 102 and 104 at a small force. The pressing plate 108 presses the contact surface of the label continuum 10 toward the rollers 102 and 104 at a small force.

A cutter 110 serving as a cutting means for cutting the label continuum 10 fed by the rollers 102 and 104 serving as the first feeding means is provided at a position proximate to the roller 104. The label continuum 10 fed by the operation of the rollers 102 and 104 is continuously cut at the boundary between the adjacent labels 12 by the cutter 110 so as to provide the label strips 10*a* each having a predetermined length. The cutter 110 is operated in correspondence to electric signals outputted from a sensor 112 such as a photo-switch provided in proximity to the cutter 110.

A belt 114 serving as a second feeding means is provided at a position proximate to the cutter 110. The belt 114 is driven by a motor (not shown) so that the label strips 10*a* are fed downstream from a position proximate to the cutter 110 to a bonding position, with the label strips 10*a* being spaced at predetermined intervals.

The belt 114 is spanned between rotatable rollers 116 and 117 spaced from each other at a predetermined interval and driven with the rotations of the roller 116 and/or the roller 117.

As in the case of the first feeding means shown in FIG. 1, a separation layer made of silicone resin or the like is formed on a contact surface 114*a* of the belt 114 so as to feed the label strip 10*a* forward, with the contact surface 114*a* lightly bonded to the pressure-sensitive adhesive layer 16 of the label strip 10*a*. A pressing roller 118 comparatively elastic or flexible is pressed against the 114*a* of the belt 114 at a small force. In this manner, the pressure-sensitive adhesive layer 16 of the label strip 10*a* is bonded lightly to the contact surface 114*a* of the belt 114.

A thermal head 120 for heating the heat-sensitive colorable layer 22 of the label strip 10*a* fed by the belt 114 is provided subsequently to the pressing roller 118. A platen 132 is provided in opposition to the thermal head 120 in such a manner that the belt 114 is interposed between the thermal head 120 and the platen 132. The thermal head 120 and the platen 132 perform a printing operation according to electric signals outputted from a sensor 121.

After the heat-sensitive colorable layer 22 of the label strip 10*a* is heat-sensitized, the label strip 10*a* is fed forward by the belt 114 serving as the second feeding means. The speed of the belt 114 is controlled according to a timing at which the heat-sensitive colorable layer 22 is heat-sensitized. A label-bonding device is provided downstream of a position proximate to the belt 114, taking into consideration of the difference of the timing between the speed of the belt 114 and the speed of feeding of the object (A). In the label-bonding device, shown in FIG. 5, according to the embodiment, a belt 126 serving as a label-bonding means provided with a speed-adjusting mechanism is spanned between a roller 128 and a roller 130. After receiving the label strip 10*a* from the belt 114, the belt 126 feeds the label strip 10*a* to the upper surface of the object (A) so that the label strip 10*a* is bonded to the upper surface of the object (A).

The printing timing of the thermal head 120 is controlled by electric signals generated upon detection of the presence of the object (A) made by a sensor 136.

In addition to the label-bonding roller 134 made of sponge shown in FIGS. 1 and 5, a label-bonding means comprising a known robot type, air type, cylinder type or a bonding pad composed of an elastic material such as rubber may be used.

Figure 7:
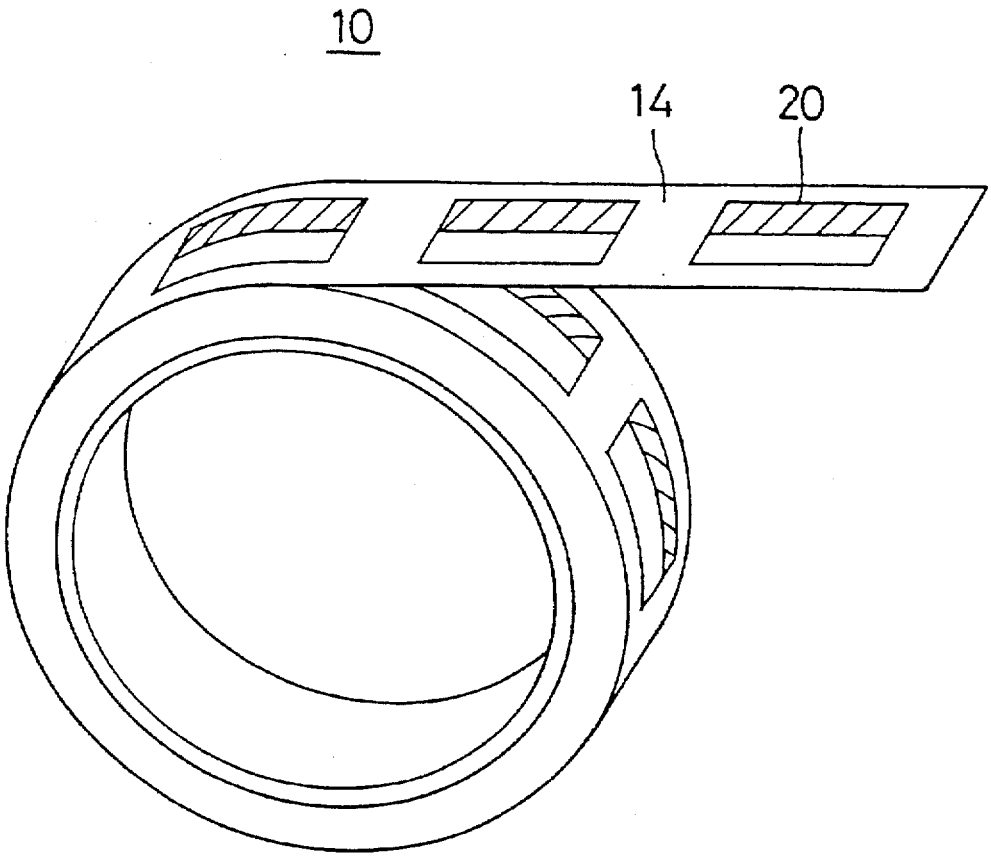
FIG. 7 is a perspective view showing a label continuum, in which a plurality of labels have been formed, to be used in the embodiment shown in FIG. 5.

Referring to FIG. 7, the base layer 14 of the label continuum 10 used in this embodiment is made of transparent material. This construction allows the transparency of the sensors 112 and 121 composed of a photo-switch to be higher than that of the printed layer 20.

While the present invention has been particularly described and shown, it is to be understood that such description is used merely as an illustration and example rather than limitation, and the spirit and scope of the present invention are determined solely by the terms of the appended claims.

What is claimed is:

1. Apparatus for bonding a label of a label continuum to an object comprising:

a first feeding means for feeding the label continuum along a first feeding path;

a cutting means downstream of said first feeding means, said cutting means cutting the label continuum fed by the first feeding means completely through the entire thickness of the label continuum to thereby separate the label continuum into a plurality of separated label strips;

a second feeding means downstream of said cutting means for receiving said label strips and for feeding said label strips at spaced intervals along a second generally linear feeding path;

said label continuum along with the labels strips having an underlying adhesive surface, said adhesive surface contacting and being adhesively adhered to said first and second feeding means and thereby preventing curling of said label continuum and said label strips on said first and second feeding means, said label continuum being released from said adhesive adherence to said first feeding means so that said label continuum releasibly passes off of said first feeding means to said cutter means where the label continuum is cut into said plurality of separated strips which then pass onto said second feeding means where said separated strips are adhesively adhered to said second feeding means;

object feeding means for feeding objects along an object feeding path; and label bonding means for sequentially bonding said label strips to said objects, said bonding means being disposed downstream of said second feeding means, said plurality of separated strips being released from said adhesive adherence to said second feeding means so that said plurality of separated strips releasibly passes off said second feeding means to said label bonding means, said bonding means being operable to sequentially press the label strips onto the objects on said object feeding means.

2. Apparatus according to claim 1 wherein said first feeding path is a generally linear feeding path, said first and second working paths being generally linearly aligned.

3. Apparatus according to claim 1 wherein said label bonding means overlies said object feeding path.

4. Apparatus according to claim 1 wherein said linear object feeding path along which said object feeding means feeds said objects is disposed at an acute angle relative to said second feeding path.

5. Apparatus according to claim 1 wherein said first and second feeding paths are disposed at an acute angle relative to horizontal.

6. Apparatus according to claim 1 wherein said first feeding means comprises an endless belt, said endless belt having a plurality of spaced projections, said spaced projections having outer terminating ends which contact said overlying adhesive surface of said label continuum to thereby minimize the area of contact and the adhesion between said first feeding means and said adhesive surface of said label continuum.

7. Apparatus according to claim 1 wherein said first feeding means comprises a plurality of spaced endless belts to thereby minimize the area of contact and the adhesion between said first feeding means and said adhesive surface of said label continuum.

8. Apparatus according to claim 1 wherein said first feeding means includes a separation layer which contacts said adhesive layer and which is operable to minimize the adhesion between said first feeding means and said adhesive surface of said label continuum.

9. Apparatus according to claim 8 wherein said separation layer comprises a silicone resin and further comprises means for continuously applying said silicon resin to said first feeding means.

10. Apparatus according to claim 1 wherein said second feeding means includes a separation layer which contacts said adhesive layer and which is operable to minimize the adhesion between said second feeding means and said adhesive surface of said label strips.

11. Apparatus according to claim 10 wherein said separation layer comprises a silicone resin and further comprises means for continuously applying said silicon resin to said second feeding means.

12. Apparatus according to claim 1 wherein said label continuum includes a heat-sensitive colorable layer, said second feeding means further comprising a thermal head for heating the heat-sensitive colorable layer.

13. Apparatus according to claim 1 wherein said label continuum includes an adhesive layer of delayed tack, said second feeding means includes activating means for activating said adhesive layer of delayed tack.

14. Apparatus for bonding a label of a label continuum to an object comprising:

a first feeding means for feeding said label continuum along a first feeding path;

a cutting means downstream of said first feeding means, said cutting means cutting the label continuum fed by the first feeding means completely through the entire thickness of the label continuum to thereby separate the label continuum into a plurality of separated label strips;

a second feeding means downstream of said cutting means for receiving said label strips and for feeding said label strips along a second generally linear path;

said label continuum along with the label strips having an underlying adhesive surface, said adhesive surface contacting and being adhesively adhered to said first and second feeding means and thereby preventing curling of said label continuum and said label strips on said first and second feeding means, said label continuum being released from said adhesive adherence to said first feeding means so that said label continuum releasibly passes off of said first feeding means to said cutter means where the label continuum is cut into said plurality of separated strips which then pass onto said second feeding means where said separated strips are adhesively adhered to said second feeding means;

object feeding means for feeding objects along a generally linear object feeding path; and a label bonding means for sequentially bonding said label strips to said objects, said label bonding means being disposed downstream of said second feeding means, said plurality of separated strips being released from said adhesive adherence to said second feeding means so that said plurality of separated strips releasibly pass off said second feeding means to said label bonding means, said bonding means moving said label strips along a third generally linear path to a position overlying an object on said object moving path, said label bonding means being operable to sequentially deposit and bond said label strips onto said objects on said object feeding path.

15. Apparatus according to claim 14 wherein said third linear path is disposed at an obtuse angle relative to said second linear path.

16. Apparatus according to claim 14 wherein said second working path is a generally horizontal working path and said third working path is disposed at an obtuse angle relative to said second working path.

17. Apparatus according to claim 14 wherein said first feeding means comprises at least two rollers underlying said label continuum, resilient pressing means overlying said label continuum and overlying said two rollers, said two rollers having spaced contact surfaces, said adhesive surface on said label continuum contacting and being adhesively adhered to said contact surfaces on said two rollers as said resilient pressing means presses said label continuum onto said spaced contact surface.

18. Apparatus according to claim 17 wherein said contact surfaces comprise a plurality of spaced circular projections.

19. Apparatus according to claim 14 wherein said label bonding means comprises an endless belt and a bonding roller, said bonding roller overlying said object feeding path and being operable to press a label strip onto an object on said object feeding means as said label strips pass off of said endless belt and sequentially move onto said object on said object feeding means.

20. Apparatus according to claim 14 wherein said second linear path and said object linear path are generally horizontal paths spaced from one another, said third path being disposed at an acute angle relative to said object feeding path.

21. Apparatus for bonding labels of a label continuum to objects comprising:

a first feeding means for feeding the label continuum along a first feeding path;

a cutting means downstream of said first feeding means, said cutting means cutting the label continuum fed by the first feeding means completely through the entire thickness of the label continuum to thereby separate the label continuum into a plurality of separated label strips;

a second feeding means downstream of said cutting means for receiving said label strips and for feeding said label strips at spaced intervals along a second feeding path;

said label continuum along with the labels strips having an underlying adhesive surface, said adhesive surface contacting and being adhesively adhered to said first and second feeding means and thereby preventing curling of said label continuum and said label strips on said first and second feeding means, said label continuum being released from said adhesive adherence to said first feeding means so that said label continuum releasibly passes off of said first feeding means to said cutter means where the label continuum is cut into said plurality of separated strips which then pass onto said second feeding means where said separated strips are adhesively adhered to said second feeding means; and label bonding means for bonding said label strips to said objects, said bonding means being disposed downstream of said second feeding means, said plurality of separated strips being released from said adhesive adherence to said second feeding means so that said plurality of separated strips releasibly passes off of said second feeding means to said label bonding means, said bonding means being operable to bond the label strips onto the objects.

22. Apparatus according to claim 1 wherein said first feeding means has a first width extending generally perpendicular to said first feeding path, said label continuum having a second width extending generally perpendicular to said first feeding path, said first width being greater than said second width.

23. Apparatus according to claim 17 wherein said second feeding means has a first width extending generally perpendicular to said second feeding path, said plurality of label strips having a second width extending generally perpendicular to said second feeding path, said first width being greater than said second width.

* * * * *